US005822438A

United States Patent [19]

Sekine et al.

[11] Patent Number: 5,822,438

[45] Date of Patent: Oct. 13, 1998

[54] SOUND-IMAGE POSITION CONTROL APPARATUS

[75] Inventors: Satoshi Sekine; Junichi Fujimori; Yasutake Suzuki, all of Hamamatsu, Japan

[73] Assignee: Yamaha Corporation, Hamamatsu, Japan

[21] Appl. No.: 378,478

[22] Filed: Jan. 26, 1995

Related U.S. Application Data

[62] Division of Ser. No. 41,818, Apr. 1, 1993.

[30] Foreign Application Priority Data

| | | | |
|---|---|---|---|
| Apr. 3, 1992 | [JP] | Japan | 4-082457 |
| Apr. 18, 1992 | [JO] | Jordan | 4-125675 |
| Jan. 29, 1993 | [JP] | Japan | 5-014287 |

[51] Int. Cl.[6] ..... H04R 5/00

[52] U.S. Cl. ..... 381/17; 381/1; 381/18; 352/25

[58] Field of Search ..... 381/17, 61, 63, 381/1, 18, 19; 84/630, DIG. 26; 352/12, 19, 25, 37

[56] References Cited

U.S. PATENT DOCUMENTS

| | | | |
|---|---|---|---|
| 3,826,566 | 7/1974 | Csontos . | |
| 3,919,478 | 11/1975 | Schott . | |
| 4,018,992 | 4/1977 | Olson . | |
| 4,495,637 | 1/1985 | Brunen . | |
| 4,685,134 | 8/1987 | Wine . | |
| 5,027,689 | 7/1991 | Fujimori . | |
| 5,046,097 | 9/1991 | Lowe et al. | 381/17 |
| 5,052,685 | 10/1991 | Lowe et al. . | |
| 5,105,462 | 4/1992 | Lowe et al. | 381/17 |
| 5,198,604 | 3/1993 | Higashi et al. . | |
| 5,291,556 | 3/1994 | Gale | 381/17 |
| 5,440,639 | 8/1995 | Suzuki et al. | 381/63 |
| 5,581,618 | 12/1996 | Satoshi et al. | 381/17 |
| 5,636,283 | 6/1997 | Hill et al. | 381/17 |
| 5,666,136 | 9/1997 | Fujishita et al. | 381/1 |
| 5,682,433 | 10/1997 | Pickard et al. | 381/17 |
| 5,684,881 | 11/1997 | Serikawa et al. | 381/86 |
| 5,696,831 | 12/1997 | Inanaga et al. | 381/74 |
| 5,742,689 | 4/1998 | Tucker et al. | 381/17 |

OTHER PUBLICATIONS

Patent Abstracts of Japan, vol. 14, No. 55 (E–882) 31 Jan. 1990: JP–A–01 279 700, Acoustic Signal Processor (Washisawa) 9 Nov. 1989.

Patent Abstracts of Japan, vol. 14, No. 95 (E–892) 21 Feb. 1990: JP–A–01 300 700, Signal Field Variable Device (Tagami) 5 Dec. 1989.

EP–A–O 393 702 (Yamaha), Signal Delay Circuit, FIR Filter and Musical Tone Synthesizer Employing the same (Yamauchi, et al.) 24 Oct. 1990.

*Primary Examiner*—Curtis A. Kuntz
*Assistant Examiner*—Xu Mei
*Attorney, Agent, or Firm*—Pillsbury Madison & Sutro LLP

[57] ABSTRACT

To obtain a sound-broadened image and a clear sound-image discrimination image when producing plural kinds of sounds, the electronic musical instrument and the like provides a sound-image position control apparatus. This apparatus at least provides a signal mixing portion (e.g., matrix controller) and a virtual-speaker position control portion. The signal mixing portion mixes plural audio signals supplied from a sound source and the like in accordance with a predetermined signal mixing procedure to output plural mixed signals. To control positions of virtual speakers which are emerged as sound-producing points as if each kind of sounds is produced from each of these points, the virtual-speaker position control portion applies different delay times to each of plural mixed signals to output delayed signals as right-side and left-side audio signals to be respectively supplied to right-side and left-side speakers. The sound-image positions formed by the virtual speakers are controlled well, so that the person can clearly discriminate and recognize each of the sound-image positions.

19 Claims, 11 Drawing Sheets

(SOUND-IMAGE POSITION CONTROL APPARATUS OF 1ST EMBODIMENT)

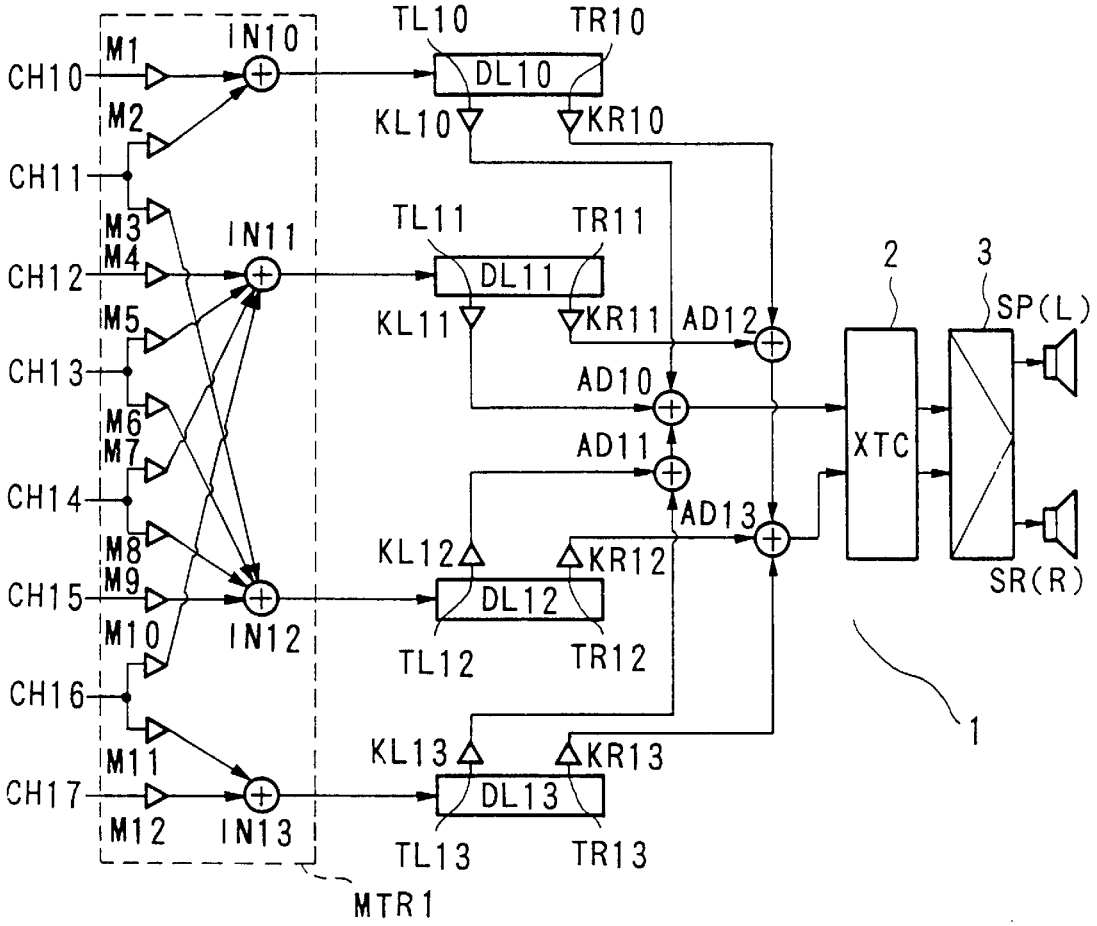
FIG.1(A) (SOUND-IMAGE POSITION CONTROL APPARATUS OF 1ST EMBODIMENT)
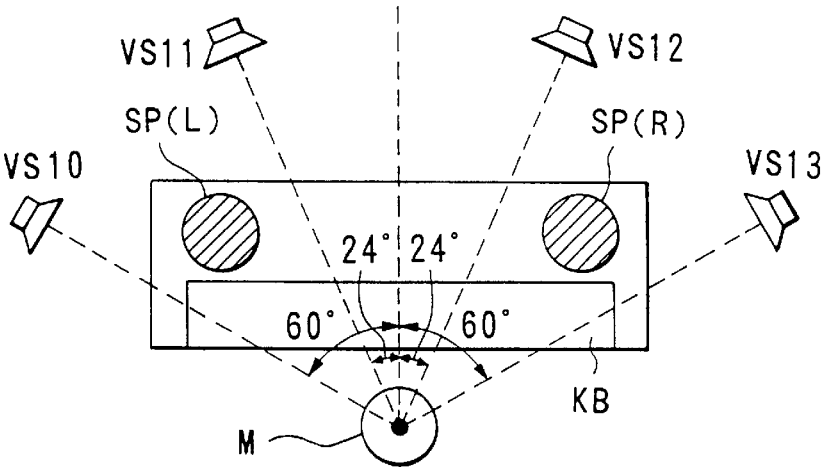
FIG.1(B) (POSITION RELATIONSHIP BETWEEN PERFORMER M AND SPEAKERS)

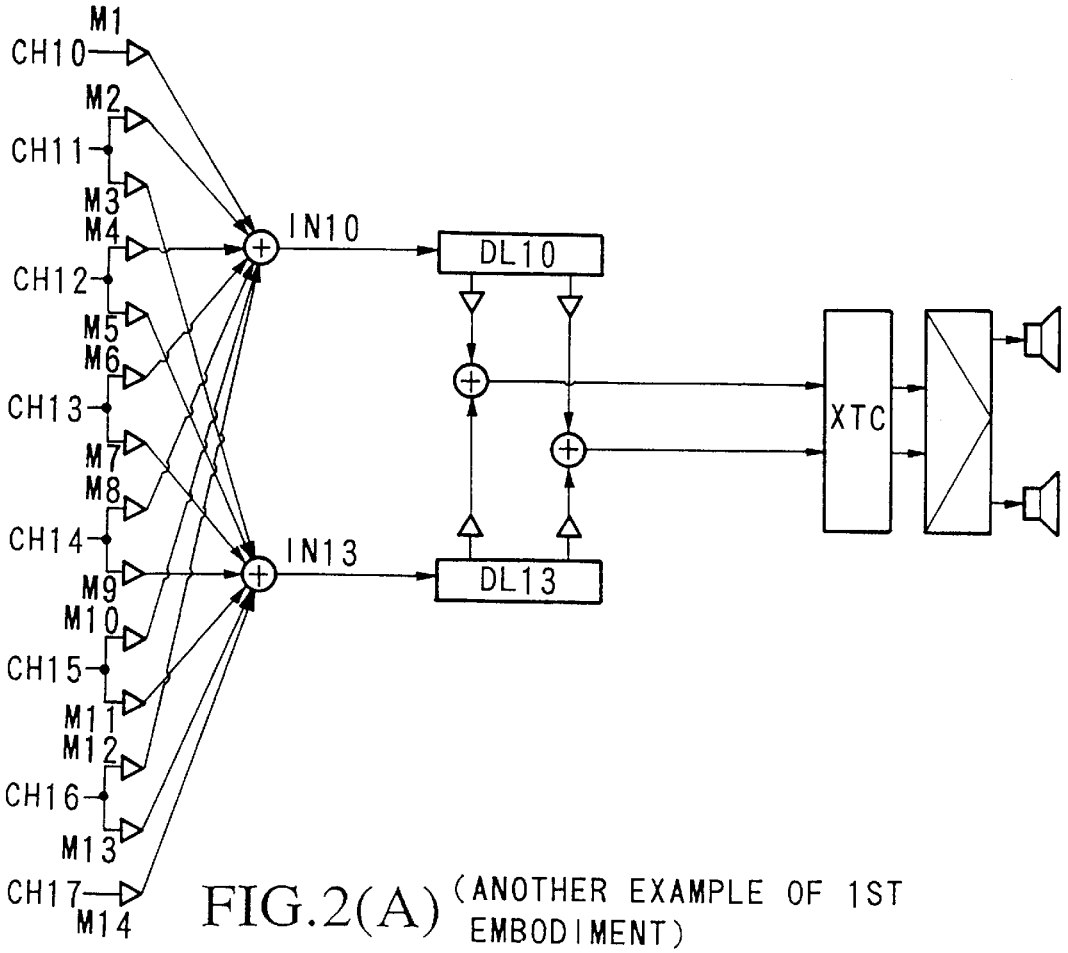
FIG.2(A) (ANOTHER EXAMPLE OF 1ST EMBODIMENT)
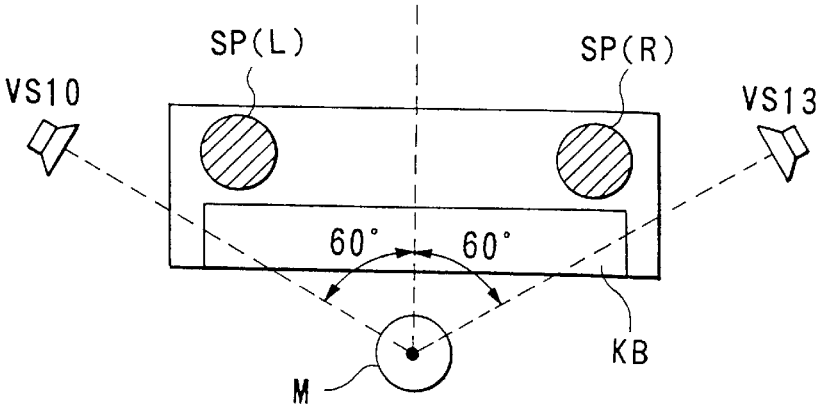
FIG.2(B)

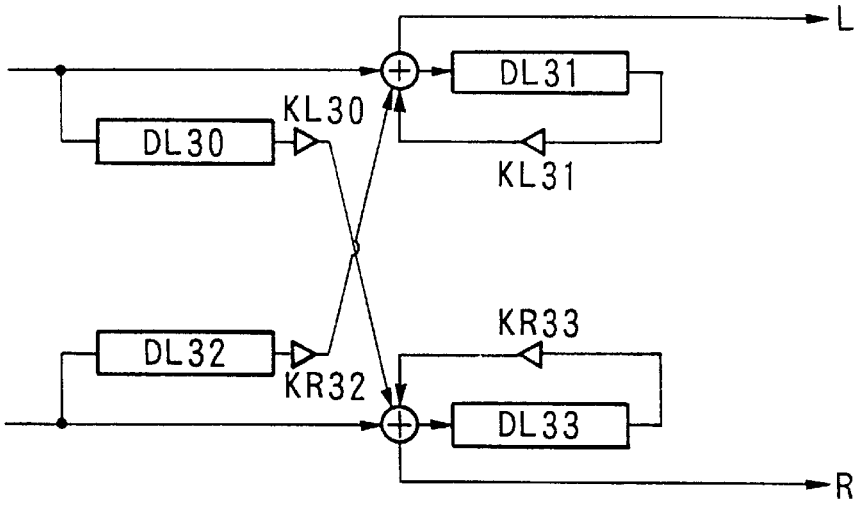
FIG.3(A) (DETAILED CONFIGURATION OF CROSS-TALK CANCELER 2)
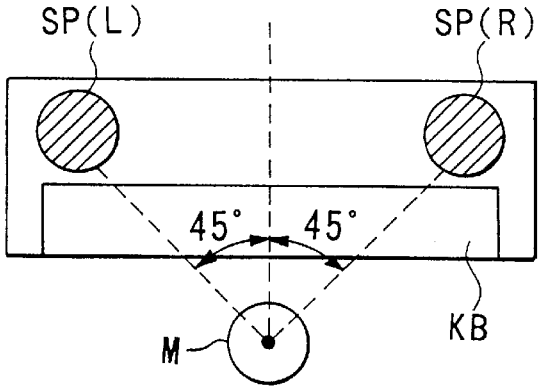
FIG.3(B)

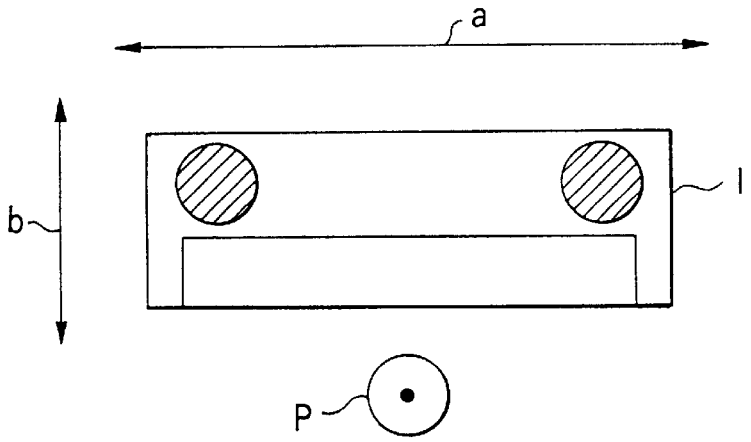
FIG.4 (POSITION RELATIONSHIP BETWEEN PERFORMER P AND INSTRUMENT I)
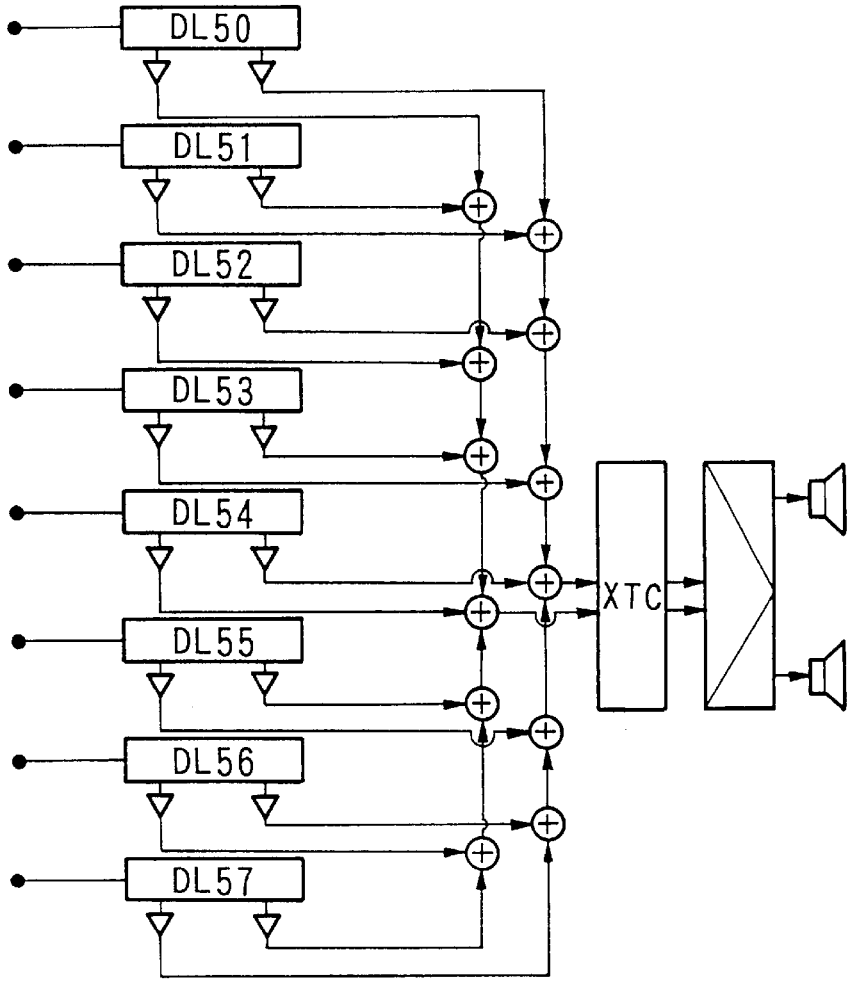
FIG.5 (MODIFIED EXAMPLE OF 1ST EMBODIMENT)

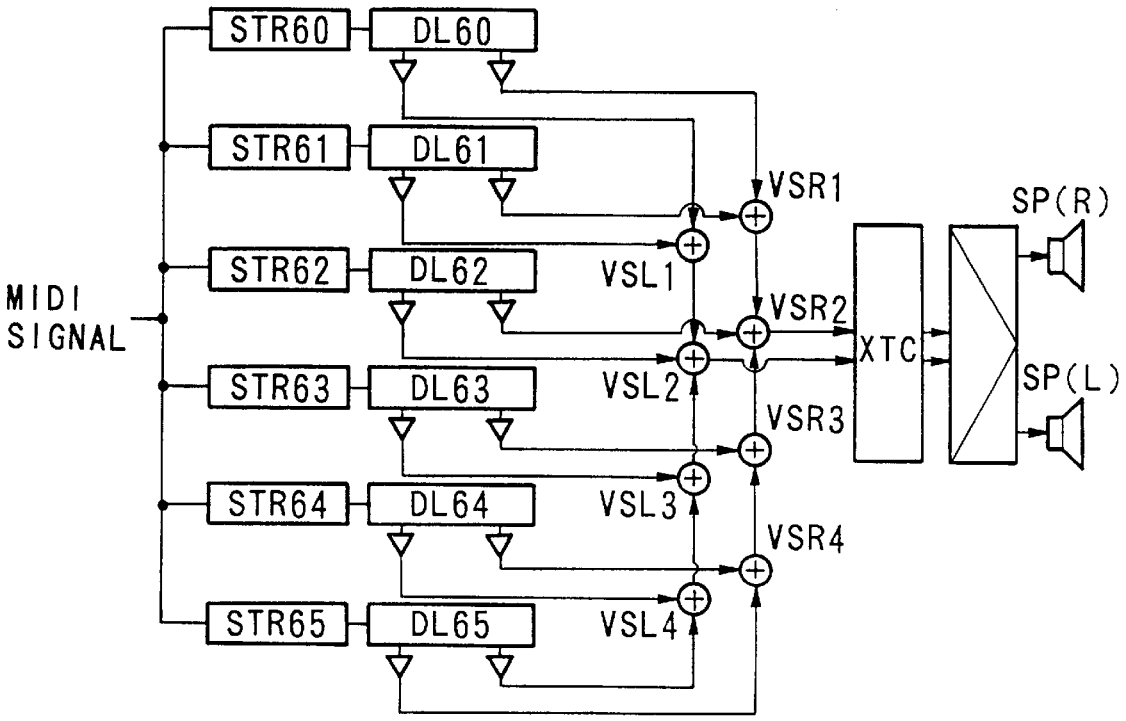

FIG.6 (SECOND EMBODIMENT)

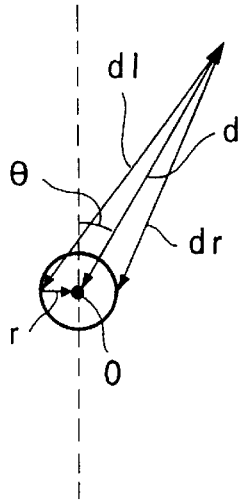

r: RADIUS OF HEAD OF PERSON M d: DISTANCE BETWEEN SOUND SOURCE AND CENTER OF HEAD dr: DISTANCE BETWEEN RIGHT EAR AND SOUND SOURCE $dr \cdot dr = r \cdot r + d \cdot d - 2rd\sin\theta$ dl: DISTANCE BETWEEN LEFT EAR AND SOUND SOURCE $dl \cdot dl = r \cdot r - d \cdot d + 2rd\sin\theta$

0: CENTER OF HEAD OF PERSON M

FIG.7 (POSITION RELATIONSHIP BETWEEN HEAD OF PERSON AND VIRTUAL SOUND SOURCE)

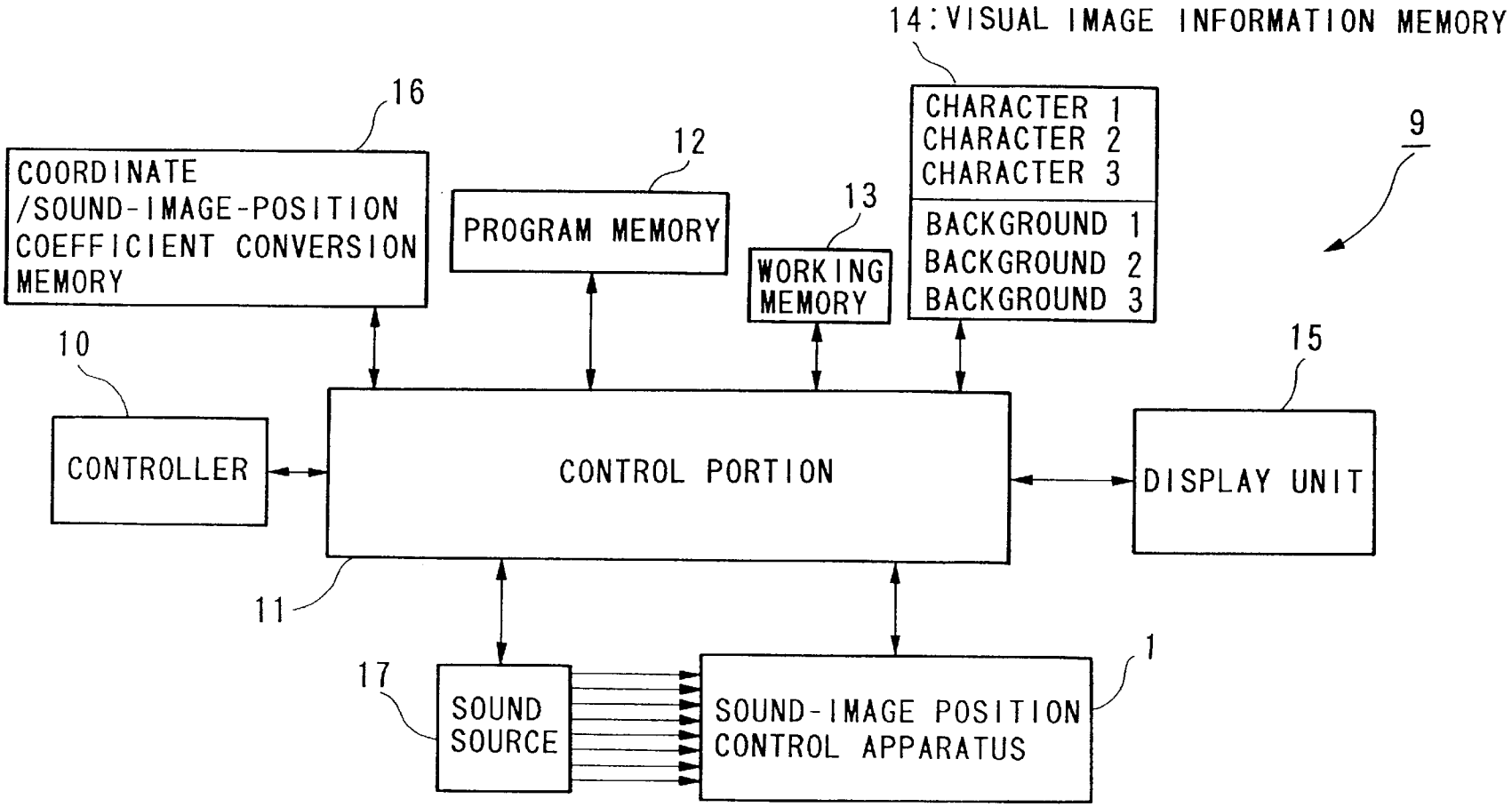
FIG. 8 (CONFIGURATION OF GAME DEVICE 9)

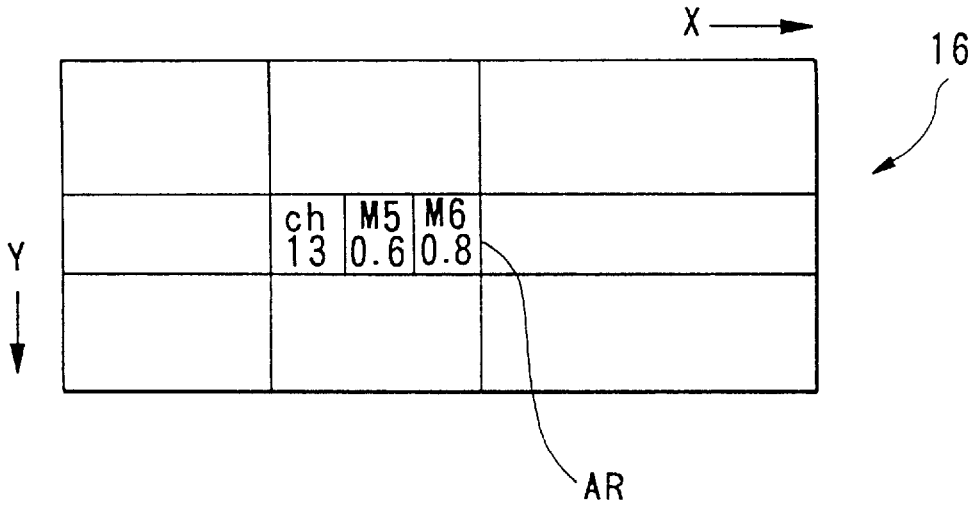
FIG.9 (MEMORY MAP OF MEMORY 16)
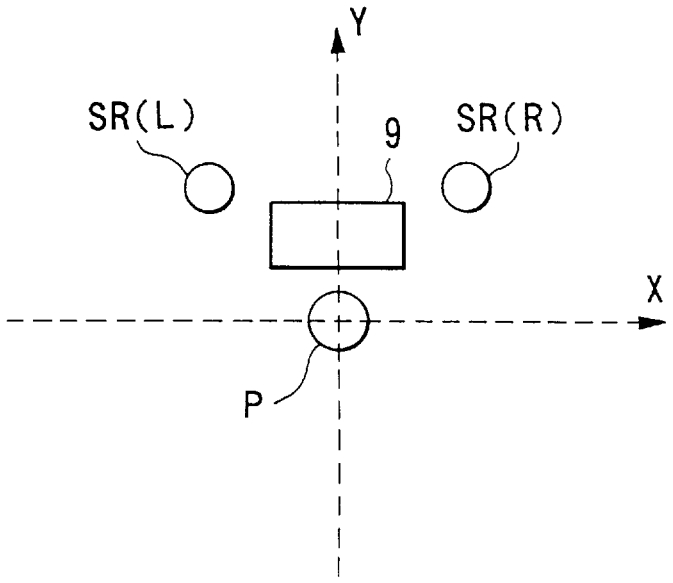
FIG.10 (POSITION RELATIONSHIP AMONG PERSON, GAME DEVICE AND SPEAKERS)

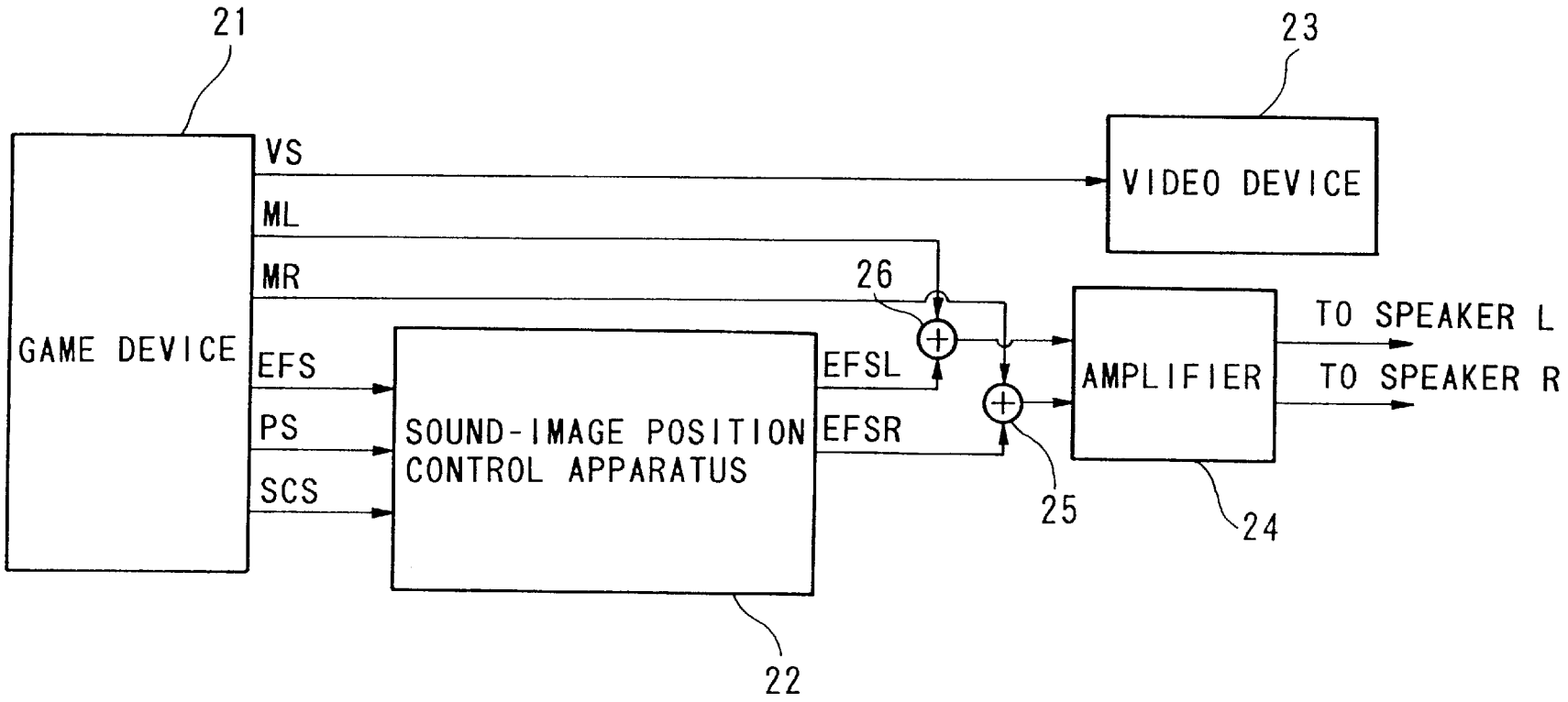
FIG.11 (WHOLE CONFIGURATION OF VIDEO GAME SYSTEM)

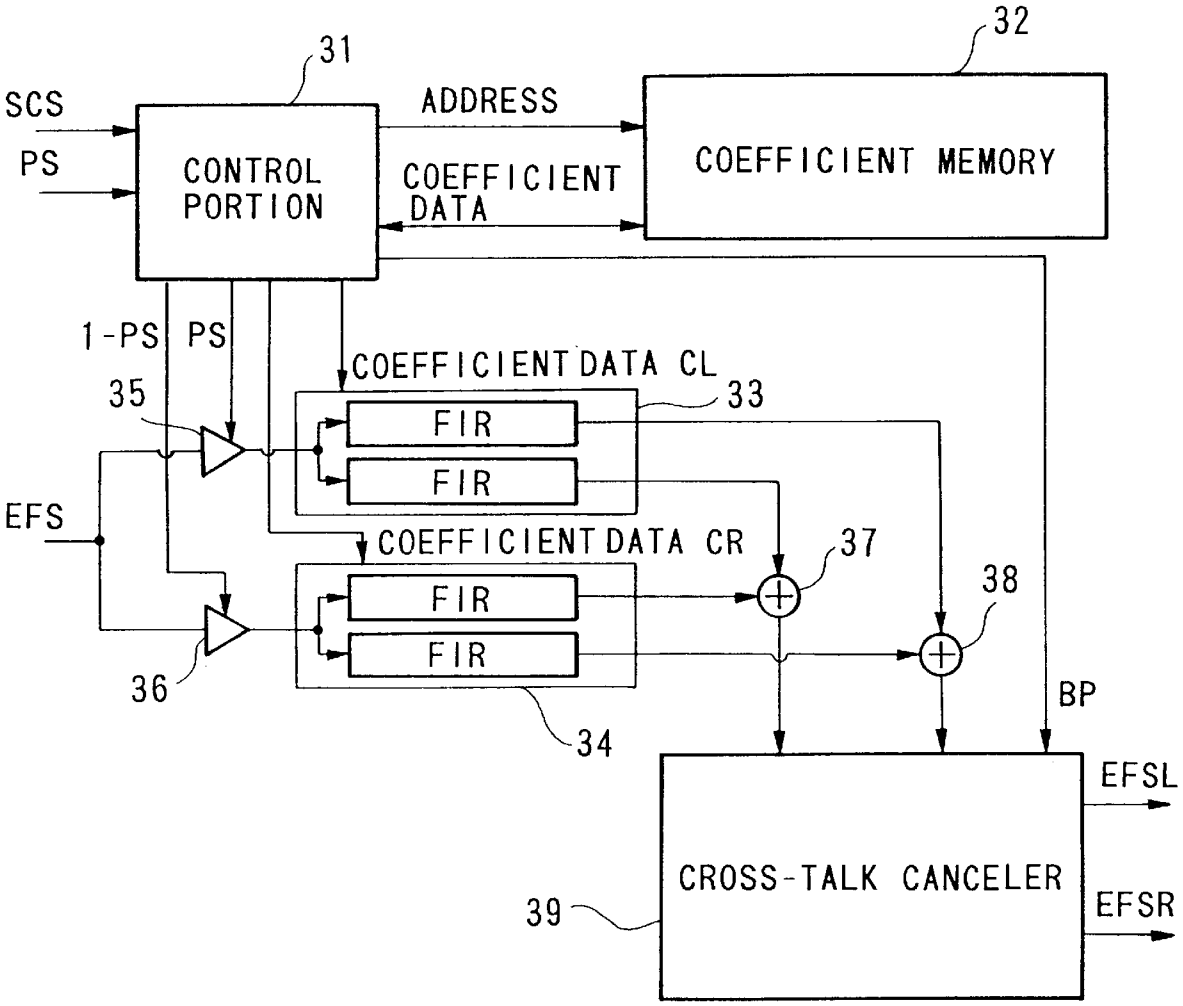
FIG. 12 (SOUND-IMAGE POSITION CONTROL APPARATUS OF 4TH EMBODIMENT)

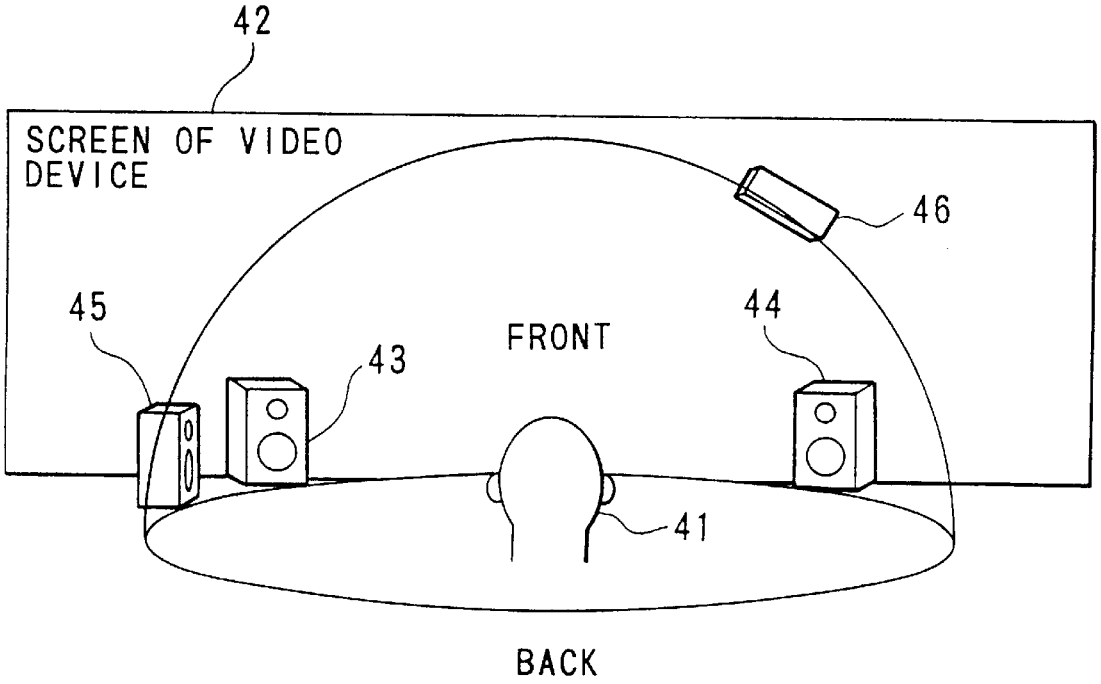
FIG.13
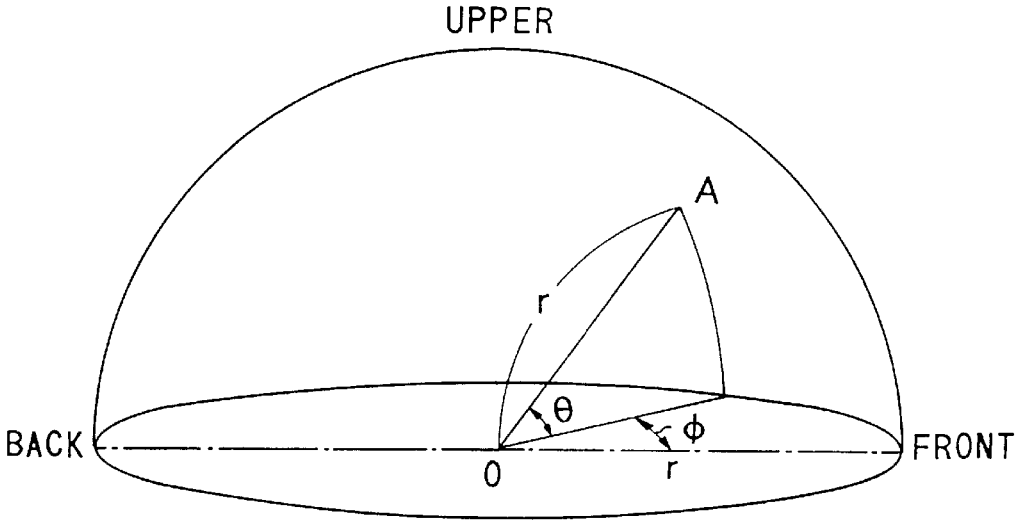
FIG.14 (POLAR-COORDINATE SYSTEM)

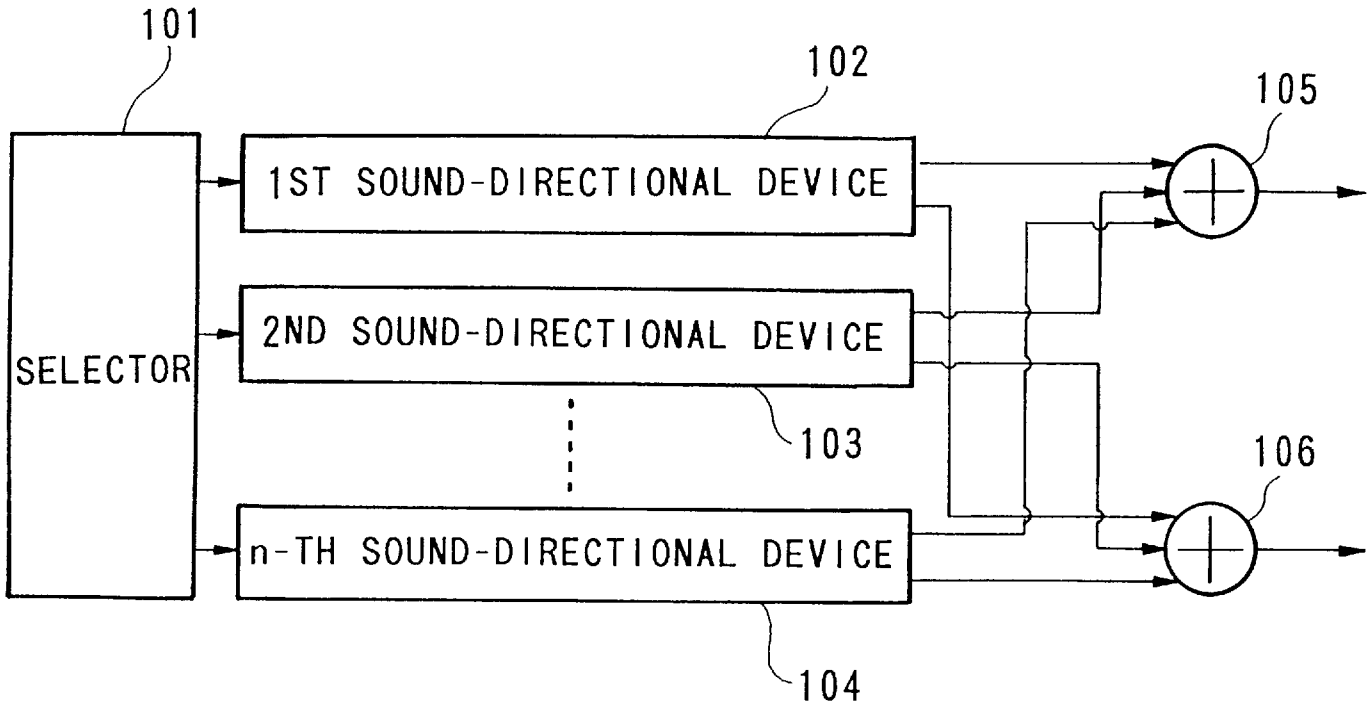
FIG. 15 (EXAMPLE OF VIRTUAL-SPEAKER CIRCUITRY)

SOUND-IMAGE POSITION CONTROL APPARATUS

SUBSTITUTE SPECIFICATION

This is a divisional of application Ser. No. 08/041,818, filed on Apr. 1, 1993.

BACKGROUND OF THE INVENTION

1. Field of the Invention

The present invention relates to a sound-image position control apparatus which is suitable for use in electronic musical instruments, audio-visual devices and the like so as to perform sound-image localization.

2. Prior Art

As devices which provide a sound-broadened image, there are provided the stereo-chorus device and the reverberation device. The former one is designed to produce a sound in which phase is slightly shifted as compared to that of an original sound. The phase-shifted sound and the original sound are alternatively produced from the left and right loud-speakers. The latter device is designed to impart a reverberation effect to the sounds.

In addition, there is another device, called the panning device. The panning device is designed to provide a predetermined output-level difference between sounds which are respectively produced from left and right loud-speakers to impart a stereophonic effect or stereo-impressive image to the sounds.

The above-mentioned stereo-chorus device or reverberation device can enlarge the sound-broadened image. However, there is a drawback in that the sound-distribution image which is sensed by the listener becomes unclear when enlarging the sound-broadened image. Herein, the sound-distribution image is defined as the degree of discrimination for which the person who listens to the music from the audio device can specifically discriminate the sound of certain instruments from other sounds. For example, when listening to music played by a guitar and a keyboard from an audio device having relatively good sound-distribution image control, the person can discriminate the respective sounds as if the guitar sound is produced from a predetermined left-side position, while the keyboard sound is produced from a predetermined right-side position. Hereinafter, such virtual position will be referred to as the sound-image position(s). When listening to music by use of the aforementioned stereo-chorus device or reverberation device, it is difficult for the person to clearly discriminate the sound-image positions.

In the panning device, the sound-image position must be fixed at a predetermined position disposed on the line connecting the left and right loud-speakers. The sound-broadened image therefore cannot be obtained. In other words, when simultaneously producing plural sounds, each having a different sound-image position, the panning device merely functions to roughly mix up those sounds so that clear sound-image positions cannot be obtained.

A panning device is frequently built in an electronic musical instrument for simulating the sounds of relatively large-scale instruments such as a piano, organ or vibraphone. In such an instrument (e.g., a piano), the sound-producing positions must be moved in accordance with the progression of notes. Thus, the panning device functions to simulate such movement of the sound-producing positions.

However, the panning device suffers from the aforementioned drawback. More specifically, the panning device can offer a certain degree of panning effect when simulating the sounds, however, it is not possible to clearly discriminate the sound-image position of each of the sounds to be produced. In short, the panning device cannot perform the accurate simulation needed for the discrimination of the sound-image positions.

SUMMARY OF THE INVENTION

It is accordingly a primary object of the present invention to provide a sound-image position control apparatus by which even when simultaneously producing plural sounds each having a different sound-image position, it is possible to clearly discriminate the sound-image position of each of the sounds to be produced.

It is another object of the present invention to provide a sound-image position control apparatus which can offer the sound-broadened effect, stereophonic effect or stereo-impressive image when simultaneously producing plural sounds each having a different sound-image position.

It is a further object of the present invention to provide a sound-image position control apparatus which can offer a sound-image localization with a simple configuration.

According to the fundamental configuration of the present invention, the sound-image position control apparatus comprises a signal mixing portion and a virtual-speaker position control portion. The signal mixing portion mixes plural audio signals supplied thereto in accordance with a predetermined signal mixing procedure so as to output plural mixed signals. The virtual-speaker position control portion applies different delay times to each of plural mixed signals so as to output delayed signals as right-side and left-side audio signals to be respectively supplied to right-side and left-side speakers. Virtual speakers emerge as sound-producing points, as if each of the sounds is produced from each of these points. Thus, sound-image positions formed by the virtual speakers are controlled in accordance with plural mixed signals.

Under effect of the aforementioned configuration of the present invention, the sounds applied with stereophonic effect and clear sound-image discrimination effect are to be actually produced from the right-side and left-side speakers as if the sounds are virtually produced from the virtual speakers. The virtual-speaker positions are determined under control of a virtual-speaker position control portion.

This apparatus may be used with a game device having a display unit which displays an animated image representing an image of an airplane or the like. By adequately controlling the sound-image position, it is possible to obtain a brand-new live-audio effect, by which the point of producing the sounds corresponding to this animated image is moved in accordance with the movement of the animated image which is moved by the player of the game.

Moreover, the present invention can be easily modified to be applied to a movie system or a video game device in which the sound-image position is controlled in response to the video image. This system comprises an audio/video signal producing portion; a scene-identification signal producing portion; a plurality of speakers; a sound-image forming portion; and a control portion.

The above-mentioned scene-identification signal producing portion outputs a scene-identification signal in response to a scene represented by the video signal. The sound-image forming portion performs predetermined processing on the audio signals so as to drive the speakers. Under effect of such signal processing, the speakers produce sound-image positions fixed at positions different than the linear spaces directly connecting the speakers. The control portion controls the contents of the signal processing so as to change over the fixed sound-image position in response to the scene-identification signal.

BRIEF DESCRIPTION OF THE DRAWINGS.

Further objects and advantages of the present invention will be apparent from the following description, reference being had to the accompanying drawings wherein the preferred embodiments of the present invention are clearly shown.

In the drawings:

FIG. 1(A) is a block diagram showing an electronic configuration of a sound-image position control apparatus according to a first embodiment of the present invention;

FIG. 1(B) is a plan view illustrating a position relationship between a performer and speakers;

FIG. 2(A) is a block diagram showing another example of the arrangement of circuit elements in a matrix controller;

FIG. 2(B) is a plan view illustrating another example of the position relationship between a performer and speakers;

FIG. 3(A) is a block diagram showing a detailed electronic configuration of a cross-talk canceler shown in FIG. 1(A);

FIG. 3(B) is a plan view illustrating another example of the position relationship between a performer and speakers;

FIG. 4 is a plan view illustrating a fundamental position relationship between a performer and speakers according to the present invention;

FIG. 5 is a block diagram showing a modified example of the first embodiment;

FIG. 6 is a block diagram showing an electronic configuration of a sound-image position control apparatus according to a second embodiment of the present invention;

FIG. 7 is a drawing showing a relationship between a person and a virtual sound source;

FIG. 8 is a block diagram showing an electronic configuration of a game device to which a sound-image position control apparatus according to a third embodiment of the present invention is applied;

FIG. 9 is a drawing showing a two-dimensional memory map of a coordinate/sound-image-position coefficient conversion memory shown in FIG. 8;

FIG. 10 is a plan view illustrating a position relationship between a player and a game device;

FIG. 11 is a block diagram showing an electronic configuration of a video game system;

FIG. 12 is a block diagram showing an electronic configuration of a sound-image position control apparatus, shown in FIG. 11, according to a fourth embodiment of the present invention;

FIG. 13 is a drawing illustrating the position relationship between a listener, loud-speakers and a video screen;

FIG. 14 illustrates a polar-coordinate system which is used for defining a three-dimensional space; and FIG. 15 is a block diagram showing a typical example of a virtual-speaker system which is applied to the fourth embodiment.

DESCRIPTION OF THE PREFERRED EMBODIMENTS

Now, description will be given with respect to embodiments of the present invention by referring to the drawings, wherein the predetermined position relationship is fixed between a performer P and an instrument I as shown in FIG. 4. In the description, the lateral direction is indicated by an arrow "a", while the longitudinal direction is indicated by an arrow "b" as shown in FIG. 4.

[A] First Embodiment (1) Configuration

FIG. 1(B) is a plan view illustrating a position relationship between a person M (i.e., performer) and an electronic musical instrument containing two speakers (i.e., loud-speakers). Herein, KB designates a keyboard having plural keys. When a key is depressed, a tone generator (not shown) produces a musical tone waveform signal having the pitch corresponding to the depressed key. SP(L) and SP(R) designate left and right speakers respectively. These speakers SP(L), SP(R) are respectively arranged at predetermined left-side and right-side positions in the upper portion of the instrument.

FIG. 1(A) is a block diagram showing an electronic configuration of a sound-image position control apparatus 1 according to a first embodiment of the present invention. This apparatus 1 provides eight channels, respectively denoted by numerals Ch10 to Ch17. Each channel receives the musical tone waveform signal produced from the tone generator. Specifically, the musical tone waveform signal supplied to each channel has the allocated frequency domain corresponding to some musical notes (hereinafter, referred to as the allocated tone area).

More specifically, the allocation of the tone areas is given as follows: the musical tone waveform signal of the tone area from the lowest-pitch note to the note C1 is supplied to the channel Ch10, while the musical tone waveform signal of the tone area from the note C#1 to the note C2 is supplied to the channel Ch11. Similarly, the tone area of C#2 to F2 is allocated to the channel Ch12; the tone area of F#2 to C3 is allocated to the channel Ch13; the tone area of C#3 to F3 is allocated to the channel Ch14; the tone area of F#3 to C4 is allocated to the channel Ch15; the tone area of C#4 to C#5 is allocated to the channel Ch16; and the tone area for the note D5 to the highest-pitch note is allocated to the channel Ch17.

M1 to M12 designate multipliers which multiply the musical tone waveform signal supplied thereto by respective coefficients CM1 to CM12. IN10 to IN13 designate adders, each of which receives the outputs of some multipliers. The above-mentioned elements, i.e., multipliers M1 to M12, adders IN10 to IN13 and channels Ch10 to Ch17 are assembled together in a matrix controller MTR1. The connection relationship and arrangement relationship among those elements of the matrix controller MTR1 can be arbitrarily changed in response to control signals and the like. A detailed explanation of the matrix controller MTR1 will be given later.

DL10 to DL13 designate delay circuits which respectively delay the outputs of the adders IN10 to IN13. Each delay circuit has two outputs, each output having a different delay time.

The signal outputted from a first output terminal TL10 of the delay circuit DL10 is multiplied by a predetermined coefficient by a multiplier KL10, and then the multiplied signal is supplied to a first input (i.e., the input for the left-side speaker) of a cross-talk canceler 2 via an adder AD10. On the other hand, the signal outputted from the second output terminal TR10 of the delay circuit DL10 is multiplied by a predetermined coefficient by a multiplier KR10, and then the multiplied signal is supplied to a second input (i.e., the input for the right-side speaker) of the cross-talk canceler 2 via adders AD12, AD13.

Similarly, the signal outputted from a first terminal TL11 of the delay circuit DL11 is eventually supplied to the first input of the cross-talk canceler 2 via a multiplier KL11 and the adder AD10, while another signal outputted from the second terminal TR11 of the delay circuit DL11 is eventually supplied to the second input of the cross-talk canceler 2 via a multiplier KR11 and the adders AD12, AD13. The signal outputted from a first terminal TL12 of the delay circuit DL12 is eventually supplied to the first input of the cross-talk canceler 2 via a multiplier KL12 and the adders AD11, AD10, while another signal outputted from the second terminal TR12 of the delay circuit DL12 is eventually supplied to the second input of the cross-talk canceler 2 via a multiplier KR12 and the adder AD13. Lastly, the signal outputted from a first terminal TL13 of the delay circuit DL13 is eventually supplied to the first input of the cross-talk canceler 2 via a multiplier KL13 and the adders AD11, AD10, while another signal outputted from the second terminal TR13 of the delay circuit DL13 is eventually supplied to the second input of the cross-talk canceler 2 via a multiplier KL13 and the adder AD13.

The above-mentioned cross-talk canceler 2 is designed to cancel the cross-talk sounds which emerge when a person hears the sounds with both ears. In other words, this is designed to eliminate the cross-talk phenomenon in which the right-side sound enters the left ear and the left-side sound enters the right ear. FIG. 3(A) shows an example of the circuitry of the cross-talk canceler 2. This circuit is designed on the basis of the transfer function of a listener's head which is obtained through the study of the sound transmission between the human ears and a dummy head (i.e., a virtual simulation model of the human head). On the basis of experimental values obtained through the transfer function of a dummy head, the study computed the sound-arrival time differences between the left and right ears and the peak values of the impulse response of the transfer function. In response to these values, this circuitry performs delay operations and weight functional calculus.

The observation is made on a model wherein the speakers SP(L), SP(R) are each positioned apart from the person M by 1.5 m and are respectively arranged at predetermined left-side and right-side positions, at an angle of 45° off of front center. Since the foregoing head transfer function is a symmetrical function, only one of the speakers SP(L), SP(R) is used to measure the sound-arrival time difference between the left and right ears and the peak values of the impulse response. The coefficients of the multipliers and the delay times of the delay circuits in the circuitry shown in FIG. 3(A) are determined on the basis of the measurement results. For example, when the result of the measurement indicates that the left/right level difference is at 6 dB (or 0.5) and the left/right time difference is at 200 $\mu$s, the same coefficient "−0.5" is applied to multipliers KL30, KR32, while the same delay time (200 $\mu$s) is set for delay circuits DL30, DL32. The other circuit elements in FIG. 3(A), i.e., delay circuits DL31, DL33 and multipliers KL31, KR33 are each configured as an all-pass filter which is provided to perform the phase matching.

As shown in FIG. 1(A), the left and right output signals of the cross-talk canceler 2 are amplified by an amplifier 3 and then supplied to the left and right speakers SP(L), SP(R), from which the corresponding left/right sounds are produced. When listening to the sounds which are produced by means of the cross-talk canceler 2, the cross talk is canceled so that clear sound separation between the left/right speakers is achieved.

Next, the functions of the delay circuits DL10-DL13 are described. In the case of the delay circuit DL10, the signal outputted from the terminal TR10 is multiplied by the predetermined coefficient in the multiplier KR10, and consequently, the multiplied signal will be converted into the musical sound by the right speaker SP(R). On the other hand, the signal outputted from the terminal TL10 is multiplied by the predetermined coefficient in the multiplier KL10, and consequently, the multiplied signal will be converted into the musical sound by the left speaker SP(L). In this case, the sound-image position is determined by two factors, i.e., the difference between the delay times of the sounds respectively produced from the right and left speakers, and the ratio between the tone volumes respectively applied to the left and right speakers. Since the present embodiment can set the above-mentioned delay-time difference in addition to the above-mentioned tone-volume ratio, the sound-image position can be set at positions which are far from the speakers SP(L), SP(R) and which depart from the line connecting these speakers. In short, it is possible to set the sound-image position in the arbitrary space which departs from the linear space connecting the speakers. In other words, the virtual speakers (which do not actually exist) are placed at arbitrary spatial positions, so that the person can listen to the sounds which are virtually produced from those positions. In the present embodiment, the delay circuit DL10 functions to set the virtual sound-producing position at VS10 (see FIG. 1(B)), which is a virtual speaker position.

Similarly, the other delay circuits DL11, DL12, DL13 respectively correspond to the virtual speakers VS11, VS12, VS13 shown in FIG. 1(B). As shown in FIG. 1(B), these virtual speakers VS10, VS11, VS12, VS13 are respectively and roughly arranged along a circular line which can be drawn about the performer. When drawing a line between the performer (i.e., the center of the circle and respective ones of the virtual speakers VS10, VS11, VS12, VS13, there are formed four angles of 60°, 24°, 24° and 60° as shown in FIG. 1(B).

Next, a description will be given with respect to the functions of the matrix controller MTR1. As described before, this matrix controller MTR1 is designed to control the connection relationship and arrangement relationship among the multipliers M1–M12, adders IN10–IN13 and channels Ch10–Ch17. Such control indicates how to assign the signals of the channels Ch10–Ch17 to the virtual speakers VS10–VS13. Thus, the sound-image position of each channel Ch can be determined by the ratio of each channel-output signal applied to each virtual speaker. In other words, panning control is carried out on the virtual speakers VS10–VS13 respectively, thus controlling the sound-image position with respect to each channel.

In the present embodiment as shown in FIG. 1(A), the allocation ratio of each channel-output signal applied to each virtual speaker is controlled by setting the coefficients of the multipliers M1–M12. For example: CM1=0.75 (by being multiplied by this coefficient, the tone volume of the musical tone waveform signal is reduced by 2.5 dB), CM2=0.75, CM3=0.25 (by being multiplied by this coefficient, the tone volume of the musical tone waveform signal is reduced by 12 dB), CM4=0.75, CM5=0.625 (by being multiplied by this coefficient, the tone volume of the musical tone waveform signal is reduced by 4.08 dB), CM6=0.313 (which is equivalent to the reduction of 10.08 dB in the tone volume of the musical tone waveform signal), CM7=0.313, CM8=0.625, CM9=0.75, CM10=0.25, CM11=0.75, CM12=0.75.

FIG. 2(A) shows another example of the arrangement and connection for the multipliers and adders under control of the matrix controller MTR1. In this example, only two delay circuits DL10, DL13 are used for the virtual speakers. As shown in FIG. 2(B), two virtual speakers VS10, VS13 are used for the production of the musical sounds. Herein, under control of the matrix controller MTR1, some of the signals of the channels Ch10–Ch17 are adequately allocated to each of the adders IN10, IN13 so as to control the sound-image positions. In this example, the coefficients of the multipliers M1–M14 are respectively set as follows: CM1=0.75, CM2=0.75, CM3=0.313, CM4=0.625, CM5=0.375 (by being multiplied by this coefficient, the tone volume of the musical tone waveform signal is reduced by 8.5 dB), CM6=0.5 (which is equivalent to the reduction of 6 dB in the tone volume of the musical tone waveform signal), CM7=0.439 (which is equivalent to the reduction of 7.16 dB in the tone volume of the musical tone waveform signal), CM8=0.439, CM9=0.5, CM10=0.375, CM11=0.625, CM12=0.313, CM13=0.75, CM14=0.75.

(2) Operation

Next, a description will be given with respect to the operation of the present embodiment.

When the performer P plays the keyboard to perform the music, the musical tone waveform signal is produced in response to each of the keys depressed by the performer. Then, the musical tone waveform signals are respectively allocated to the channels on the basis of the predetermined tone-area allocation manner, so that these signals eventually enter into the matrix controller MTR1. Assuming that the circuit elements of the matrix controller MTR1 are arranged and connected as shown in FIG. 1(A), the musical tone waveform signals are produced as musical sounds from the virtual speakers VS10–VS13 in accordance with their tone areas.

The musical tone waveform signals corresponding to the tone area between the lowest-pitch note and the C1 note (see Ch10) are produced as musical sounds from the virtual speaker VS10. In addition, the musical tone waveform signals corresponding to the tone area between the C#1 note and the C2 note (see Ch11) are produced as the musical sounds from the virtual speakers VS12, VS10. However, due to the coefficients of the multipliers M2, M3, the sound-image positions corresponding to those notes are placed close to the virtual speaker VS10. More specifically, the sound-image positions are arranged on the line connecting the virtual speakers VS12, VS10, but they are located close to the virtual speaker VS10. Further, the musical tone waveform signals corresponding to the tone area between the C#2 note to F2 note (see Ch12) are produced as the musical sounds from the virtual speaker VS11. Similarly, the other musical tone waveform signals corresponding to each of the other tone areas (i.e., each of the other channels) are eventually produced as musical sounds from a predetermined one or two virtual speakers at certain sound-image positions. Thus, the sound-image positions corresponding to the tone areas which are respectively arranged from the lowest pitch to the highest pitch are sequentially arranged from the left-side position to the right-side position along a circular line drawn about the performer P (see FIG. 1(B)). As a result, when the performer P sequentially depresses the keys from the lower pitch to the higher pitch, the sound-image positions are sequentially moved from the left-side position to the right-side position along the above-mentioned circular line. In short, it is possible to control the left/right and front/back positionings of the sound images.

When the circuit elements of the matrix controller MTR1 are arranged and connected as shown in FIG. 2(A), the musical tone waveform signals of each tone area are eventually produced as the musical sounds from one or both of the virtual speakers VS10, VS13. Thus, the positioning control of the sound images are controlled on the line connecting these virtual speakers. In this case, the control of the front/back-side sound-broadened image is poor as compared to that of FIG. 1(A). However, as compared to the state where the musical sounds are merely produced from the left/right speakers SP(L), SP(R), this FIG. 2 example can improve the control of the front/back-side sound broadened image.

As described heretofore, the first embodiment is designed to change the allocation manner of the musical tone waveform signals by use of the matrix controller MTR1. Therefore, it is possible to change the control manner of the sound images with ease.

(3) Modified Example

FIG. 5 is a block diagram showing a modified example of the foregoing first embodiment, in which there are provided eight delay circuits DL50–DL57 used for creating the virtual speakers. In FIG. 5, the illustration is partially omitted, so that there are also provided eight adders, in the matrix controller MTR1, respectively corresponding to the above-mentioned eight delay circuits DL50–DL57. According to the configuration of this modified example, eight virtual speakers emerge, so that the musical tone waveform signals can be adequately allocated to these virtual speakers. Due to the provision of eight virtual speakers, it is possible to perform more precise control of the sound-image positions.

[B] Second Embodiment

Next, a description will be given with respect to the second embodiment of the present invention by referring to FIG. 6, wherein some parts corresponding to those of the foregoing first embodiment are omitted.

In FIG. 6, numerals STR60–STR65 designate respective tone generators which are controlled by a MIDI signal (i.e., digital signal having a format based on the standard for Musical Instruments Digital Interface). One of the tone generators STR60–STR65 designated by the MIDI signal is activated to produce the musical tone waveform signal. The outputs of these tone generators STR60–STR65 are respectively supplied to the delay circuits DL60–DL65 which are respectively used for forming the virtual speakers. Then, the outputs of the delay circuits DL60–DL65 are respectively multiplied by predetermined coefficients, so that some of the multiplied outputs are added together in adders VSR1–VSR4, VSL1–VSL4. The addition results are supplied to the cross-talk canceler 2.

According to the configuration of the above-mentioned second embodiment, the output of each tone generator is produced as the musical sound from a certain virtual speaker. Thus, when respectively connecting six strings of the guitar with six tone generators STR60–STR65, it is possible to simulate well the sound-producing manner of the guitar with respect to each string. The reason why such simulation can be performed well by the second embodiment is as follows.

When the guitar is located close to the listener so that the strings are located close to the ears of the listener, the listener can clearly discriminate the separate sound produced from each string of the guitar. However, as the distance between the listener and guitar becomes larger, the sound-separation image of each string of the guitar becomes weaker. Therefore, in the end, the sounds produced from all the strings of the guitar will be heard as one overall sound which is produced from one sound-production point. Thus, by adequately setting the delay times of the delay circuits DL60–DL65 and the coefficients which are multiplied with the outputs of the delay circuits DL60–DL65, it is possible to offer distinct images for the instrument which are distant from the listener.

It is possible to compute the distance between the person and the virtual sound source which is embodied by the delay circuit as shown in FIG. 7. Herein, "r" designates a radius of the head of the person M; "d" designates a distance between the sound source and the center of the listener's head; and "θ" designates an angle which is formed between the sound source and the front-direction line of the head. In this case, it is possible to compute distances "dr" and "dl" by the following equations, wherein "dr" designates a distance between the sound source and the right ear of the person, while "dl" designates a distance between the sound source and the left ear of the person.

$$dr^2=r^2+d^2-2rd\cdot\sin\theta \quad (1)$$

$$dl^2=r^2-d^2+2rd\cdot\sin\theta \quad (2)$$

Thus, by computing these distances dr, dl with respect to each of the strings, it is possible to determine the factors for designing the delay circuits DL60–DL65.

In the aforementioned embodiments, it is possible for the user to arbitrarily set the connection pattern of the matrix controller MTR1 and the coefficient applied to each of the multipliers. It is also possible to store plural connection patterns and plural values for each coefficient in advance, so that the user can arbitrarily select one of them.

[C] Third Embodiment

Next, a description will be given with respect to the third embodiment of the present invention, in which the sound-image position control apparatus 1 is applied to a game device 9, by referring to FIGS. 8 to 10.

FIG. 8 is a block diagram showing the electronic configuration of a game device 9. Herein, 10 designates a controller which controls and reads a joy-stick unit, tracking-ball unit and several kinds of push-button switches (not shown) so that the operating states of them are sent to a control portion 11. The control portion 11 contains a central processing unit (i.e., CPU) and several kinds of interface circuits. The control portion 11 executes predetermined game programs stored in a program memory 12. Thus, while the game is in progress, the overall control of the game device is performed by the control portion 11. In the progress of the game, a working memory 13 is collecting and storing several kinds of data which are obtained through the execution of the game programs. In response to the game program to be executed, a visual image information memory 14 stores visual image data to be displayed, representing the information of the visual images corresponding to character images C1, C2, C3 (beginning with the letter "C") and background images BG1, BG2, BG3 (beginning with the letters "BG"). These character images may correspond to the visual images of a person, automobile, airplane, animal, or other kinds of objects. The above-mentioned visual image data are read out in the progress of the game, so that the corresponding visual image is displayed at predetermined positions on a display screen of a display unit 15 in response to the progress of the game.

A coordinate/sound-image-position coefficient conversion memory 16 stores parameters by which the display position of the character C in the display unit 15 is located at the proper position corresponding to the sound-image position in the two-dimensional area. FIG. 9 shows a memory configuration of the above-mentioned coordinate/sound-image-position coefficient conversion memory 16. FIG. 10 shows a position relationship between a player P of the game and the game device 9 in the two-dimensional area. The X-Y coordinates of the coordinate/sound-image-position coefficient conversion memory 16 shown in FIG. 9 may correspond to the X-Y coordinates of the display screen of the display unit 15. In FIG. 9, the output channel number CH of a sound source 17 and some of the coefficients CM1–CM12 which are used by the multipliers M1–M12 in the sound-image position control apparatus 1 are stored at the memory area designated by the X-, Y-coordinate values which indicate the display position of the character C on the display unit 15. For example, at an area designated by "AR", a value "13" is stored as the output channel number, while the other values "0.6" and "0.8" are stored as the coefficients CM5, CM6 used for the multipliers M5, M6 respectively.

The X/Y coordinates of the coordinate/sound-image-position coefficient conversion memory 16 are set corresponding to those of the actual two-dimensional area shown in FIG. 10. In other words, the display position of the character C in the display unit 15 corresponds to the actual two-dimensional position of the player as shown in FIG. 10. Thus, by adequately setting the parameters, the sounds will be produced from the actual position corresponding to the display position of the character C. The memory area of the coordinate/sound-image-position coefficient conversion memory 16 is preferably set larger than the display area of the display unit 15. In this case, the proper channel number CH and some of the coefficients CM1–CM12 are memorized such that even if the character C is located at the coordinates of a position which cannot be displayed by the display unit 15, the sounds are produced from the actual position corresponding to the coordinates of the character C. Moreover, the display position of the character C is controlled to be automatically changed in response to the progress of the game on the basis of the game program stored in the program memory 12, or it is controlled to be changed in response to the manual operation applied to the controller 10.

Sound source 17 has plural channels used for the generation of the sounds, which are respectively operated in a time-division manner. Thus, in response to instruction given from the control portion 11, each channel produces a musical tone waveform signal. Such musical tone waveform signal is delivered to a predetermined one or more of the eight channels CH10–Ch17 of the sound-image position control apparatus 1. Particularly, the musical tone waveform signal for the character C is delivered to a certain channel Ch which is designated by the foregoing output channel number CH. As described before, this sound-image position control apparatus 1 has the electronic configuration as shown in FIG. 1(A), wherein the predetermined coefficients CM1–CM12 are respectively applied to the multipliers M1–M12 so as to control the sound-image position of each channel Ch when producing the sounds from the speakers SP(L), SP(R).

According to the electronic configurations as described heretofore, when power is applied to the game device 9, the control portion 11 is activated to execute the programs stored in the program memory 12 so as to progress the game. In response to the progress of the game, one of the background images BG1, BG2, BG3 is selectively read from the visual image information memory 14 so that the selected background image is displayed on the display screen of the display unit 15. Similarly, one of the character images C1, C2, C3 is selectively read out so that the selected character image is displayed in the display unit 15. The control portion 11 gives an instruction to the sound source 17 so as to produce the musical tone waveform signals corresponding to the background music in response to the progress of the game. In addition, the control portion 11 also instructs the sound source 17 to produce other musical tone waveform signals having the musical tone characteristics (such as tone color, tone pitch, sound effects, etc.) corresponding to the character C. Moreover, the control portion 11 reads out the output channel number CH and coefficient CM (i.e., one or some of CM1–CM12) from the memory area of the coordinate/sound-image-position coefficient conversion memory 16 corresponding to the display position of the character C in the display unit 15. Then the read data are supplied to the sound source 17 and sound-image position control apparatus 1 respectively. In this case, the sound source 17 produces the musical tone waveform signal corresponding to the character C, and this musical tone waveform signal is outputted to the sound-image position control apparatus 1 from the channel Ch which is designated by the output channel number CH. The other musical tone waveform signals are also outputted to the sound-image position control apparatus 1 from the corresponding channels respectively. In the sound-image position control apparatus 1, each of the coefficients CM read from the coordinate/sound-image-position coefficient conversion memory 16 is supplied to each of the multipliers M1–M12. Thus, the sound-image position of each channel is controlled to be fixed responsive to the coefficient CM. Consequently, the musical sounds are produced from the speakers SP(L), SP(R) at the fixed sound-image positions.

When the player P intentionally operates the controller 10 to move the character C, the control portion 11 is operated so that the display position of the character C displayed in the display unit 15 is moved by the distance corresponding to the manual operation applied to the controller 10. In this case, a new output channel number CH and coefficient(s) CM are read from the memory area of the coordinate/sound-image-position coefficient conversion memory 16 corresponding to the new display position of the character C. Consequently, these data are supplied to the sound source 17 and sound-image position control apparatus 1 respectively. Thus, the actual sound-image position is also moved responsive to the movement of the character C.

According to the present embodiment, when the character C representing the visual image of an airplane is located outside of the display area of the display unit 15 and such character C is moved closer to the player P from his back, the character C is not actually displayed on the display screen of the display unit 15. However, since the foregoing coordinate/sound-image-position coefficient conversion memory 16 has a memory area which is larger than the display area of the display unit 15, the sounds corresponding to the character C are actually produced such that the sounds are coming closer to the player P from his back. As a result, the player P can recognize the existence and movement of the airplane for which a visual image is not actually displayed. This can offer a brand-new live-audio effect which cannot be obtained from conventional game device systems.

The present embodiment is designed to manage the movement of the character C in a two-dimensional coordinate system. Of course, the present invention is not limited to it, so that the present embodiment can be modified to manage the movement of the character C in a three-dimensional coordinate system. In such modification, the number of actual speakers is increased, and they are arranged in the three-dimensional space.

In the present embodiment, the X/Y coordinates of the display unit 15 are set corresponding to those of the actual two-dimensional area. However, this embodiment can also be modified to simulate an automobile race. In this case, only the character C which is displayed in front of the player P is displayed in the display unit 15 by matching the visual range of the player P with the display area of the display unit 15.

[D] Fourth Embodiment

Next, a description will be given with respect to the fourth embodiment of the present invention, wherein the sound-image position control apparatus is modified to be applied to a movie system, video game device (or television game device) or a so-called CD-I system in which the sound-image position is controlled responsive to the video image.

Before describing the fourth embodiment in detail in conjunction with FIGS. 11 to 13, a description will be given with respect to the background of the fourth embodiment by referring to FIGS. 14 and 15.

First of all, the so-called binaural technique is known as a technique which controls and fixes the sound-image position in the three-dimensional space. According to the known technique, the sounds are recorded by use of microphones which are located within the ears of a foregoing dummy head. The recorded sounds are reproduced by use of a headphone set so as to allow the listener to recognize a sound-image position which is fixed at a predetermined position in the three dimensional space. Recently, some attempts have been made to simulate the tone area which is formed in accordance with the shape of the dummy head. In other words, by simulating the transfer function of the sounds which are transmitted in the three-dimensional space by use of the digital signal processing technique, the sound-image position is controlled to be fixed in the three-dimensional space.

The coordinate system of the above-mentioned three dimensional space can be defined by use of the illustration of FIG. 14. In FIG. 14, "r" designates a distance from the origin "O"; θ designates an azimuth angle with respect to the horizontal direction which starts from the origin "O"; θ designates an elevation angle with respect to the horizontal area containing the origin "O", thus, the three-dimensional space can be defined by the polar coordinates. When locating the listener or dummy head at the origin O, its front direction can be defined as θ=0, whereas its left-side direction is defined by θ>0 and its right-side direction is defined by θ=<0. In addition, the upper direction is defined by θ>0.

As a model which controls and fixes the sound-image position in the three-dimensional space by use of the digital signal processing technique, the dummy head is located at the origin O and then the impulse signal is produced from a predetermined point A, for example. Then, the responding sounds corresponding to the impulse signal are sensed by the microphones which are respectively located within the ears of the dummy head. These sensed sounds are converted into digital signals which are recorded by some recording medium. These digital signals represent two impulse-response data respectively corresponding to the sounds picked up by the left-side and right-side ears of the dummy head. These two impulse-response data are converted into coefficients, can be supplied to two finite-impulse response digital filters (hereinafter, simply referred to as FIR filters). In this case, the audio signal for which the sound-image position is not fixed is delivered to two FIR filters, through which two digital outputs are obtained as the left/right audio signals. These left/right audio signals are applied to left/right inputs of the headphone set, so that the listener can hear the stereophonic sounds from this headphone set as if those sounds are produced from the point A. By changing this point A and measuring the impulse response, it is possible to obtain other coefficients for the FIR filters. In other words, by locating the Point A at the desirable position, it is possible to obtain coefficients for the FIR filters, by which the sound-image position can be fixed at a desirable position. The above-mentioned technique offers an effect by which the three-dimensional sound-image position is determined by use of the sound-reproduction system of the headphone set. The same effect can be embodied by use of the so-called two-speaker sound-reproduction system in which two speakers are located at the predetermined front positions of the listener, which is called a cross-talk canceling technique.

According to the cross-talk canceling technique, the sounds are reproduced as if they are produced from a certain position (i.e., the position of the foregoing virtual speaker) at which the actual speaker is not located. Herein, two FIR filters are required when locating one virtual speaker. Hereinafter, a set of two FIR filters will be called as a sound-directional device.

FIG. 15 is a block diagram showing an example of the virtual-speaker circuitry which employs the above-mentioned sound-directional device. In FIG. 15, 102–104 designate sound-directional devices, each of which contains two FIR filters. This drawing only illustrates three sound-directional devices 102–104, however, there may be provided several hundreds of the sound-directional devices. Thus, it is possible to locate hundreds of virtual speakers in a close-tight manner with respect to all of the directions of the polar-coordinate system. These virtual speakers are not merely arranged along a spherical surface with respect to the same distance r, but they are also arranged in a perspective manner with respect to different distances r. A selector 101 selectively delivers the input signal to one of the sound-directional devices such that the sounds will be produced from a predetermined one of the virtual speakers, thus controlling and fixing the sound-image position in the three-dimensional space. Incidentally, adders 105, 106 output their addition results as the left/right audio outputs respectively.

The above-mentioned example can be modified such that one sound-directional device is not fixed corresponding to one direction of producing the sound. In other words, by changing the coefficients of the FIR filters contained in one sound-directional device, it is possible to move the sound-image position by use of only one sound-directional device.

Some movie theaters employ a so-called surround acoustic technique which uses four or more speakers. Therefore, the sounds are produced from one or some speakers in response to the video image.

When embodying such surround acoustic technique by use of the former virtual-speaker system providing hundreds of sound-directional devices, it is necessary to provide hundreds of FIR filters, which enlarges the scale of the system so that the cost of the system will be raised. Even in the case of the latter system which provides only one sound-directional device, it is necessary to provide hundreds of coefficients used for the FIR filter, which is not realistic. This is because it is very difficult to control or change so many coefficients in a real-time manner. Further, when embodying the foregoing surround acoustic technique in a movie theater, it is necessary to provide many amplifiers and speakers, which raises the cost of the facilities.

(a) Configuration of the Fourth Embodiment

Next, a detailed description will be given with respect to the fourth embodiment of the present invention. FIG. 11 is a block diagram showing the whole configuration of the video game system. Herein, a game device 21 is designed to produce a video signal VS, a left-side musical tone signal ML, a right-side musical tone signal MR, a sound effect signal EFS, a panning signal PS and a scene-identification signal SCS. When receiving the sound effect signal EFS, panning signal PS and scene-identification signal SCS, a sound-image position control apparatus 22 imparts the fixed sound image to the sound effect signal EFS, thus producing two signals EFSL, EFSR. Then, an adder 25 adds the signals EFSR and MR together, while an adder 26 adds the signals EFSL and ML together. The results of the additions respectively performed by the adders 25, 26 are supplied to an amplifier 24. The amplifier 24 amplifies these signals so as to respectively output the amplified signals to left/right loud-speakers (represented by 43, 44 in FIG. 13). In the meantime, the video signal VS is supplied to a video device 23, so that the video image is displayed for the person.

The game device 21 is configured as the known video game device which is designed such that responsive to the manipulation of the player of the game, the scene displayed responsive to the video signal VS is changed or the position of the character image is moved. During the game, the musical tone signals ML, MR are outputted so as to play the background music. In addition to this background music, other sounds are also produced. For example, the sounds corresponding to the character image which is moved responsive to the manipulation of the player, or the other sounds corresponding to the other character images which are automatically moved under control of the control unit built in the game device 21 are produced by the sound effect signal EFS. In case of the game of the automobile race, the engine sounds of the automobiles are automatically produced.

The scene-identification signal SCS is used for determining the position of the virtual speaker in accordance with the scene. Every time the scene is changed, this scene-identification signal SCS is produced as the information representing the changed scene. Such scene-identification signal SCS is stored in advance within a memory unit (not shown) which is built in the game device 21. More specifically, this signal is stored at a predetermined area adjacent to the area storing the data representing the background image with respect to each scene of the game. Thus, when the scene is changed, this signal is simultaneously read out.

On the other hand, the panning signal PS represents a certain position which is located between two virtual speakers. By varying the value of this panning signal PS between "0" and "1", it is possible to freely change the sound-image position corresponding to the sound produced responsive to the sound effect signal EFS between two virtual speakers. In the present embodiment, the programs of the game contain the operation routine for the panning signal PS, by which the panning signal PS is computed on the basis of the scene-identification signal SCS and the displayed position of the character image corresponding to the sound effect signal EFS. Of course, such computation of the panning signal PS can be omitted, so that in response to the position of the character, the game device 21 automatically reads out the panning signal PS which is stored in advance in the memory unit. Incidentally, the present embodiment is designed such that two virtual speakers emerge, which will be described later in detail.

FIG. 12 is a block diagram showing an internal configuration of the sound-image position control apparatus 22. Herein, a control portion 31 is configured as the central processing unit (i.e., CPU), which performs the overall control on this apparatus 22. This control portion 31 receives the foregoing scene-identification signal SCS and panning signal PS. A coefficient memory 32 stores the coefficients of the FIR filters. As described before, the impulse response is measured with respect to the virtual speaker which is located at a desirable position, so that the above-mentioned coefficients are determined on the basis of the result of the measurement. In order to locate the virtual speaker at the optimum position corresponding to the scene of the game, the coefficients for the FIR filters are computed in advance with respect to several positions of the virtual speaker, and consequently, these coefficients are stored at the addresses of the memory unit corresponding to the scene-identification signal SCS. As described before, each of sound-directional devices 33, 34 is configured by two FIR filters. The coefficient applied to the FIR filter can be changed by the coefficient data given from the control portion 31.

In response to the scene-identification signal SCS, the control portion 11 reads out the coefficient data, respectively corresponding to the virtual speakers L, R, from the coefficient memory 32, and consequently, the read coefficient data are respectively supplied to the sound-directional devices 33, 34. When receiving the coefficients, each of the sound-directional devices 33, 34 performs the predetermined signal processing on the input signal of the FIR filters, thus locating the virtual speaker at the optimum position corresponding to the scene-identification signal SCS.

The sound effect signal EFS is allocated to the sound-directional devices 33, 34 via multipliers 35, 36 respectively. These multipliers 35, 36 also receive the multiplication coefficients respectively corresponding to the values "PS", "1-PS" from the control portion. Herein, the value "PS" represents the value of the panning signal PS, while the value "1-PS" represents the one's complement of the panning signal PS. The outputs of first FIR filters in the sound-directional devices 33, 34 are added together by an adder 37, while the other outputs of second FIR filters in the sound-directional devices 33, 34 are added together by another adder 38. Therefore, these adders 37, 38 output their addition results as signals for the speakers 43, 44 respectively. These signals are supplied to a cross-talk canceler 39.

The cross-talk canceler 39 is provided to cancel the cross-talk component included in the sounds. For example, the cross-talk phenomenon occurs when producing sounds from the speakers 43, 44 in FIG. 13. Due to this cross-talk phenomenon, the sound component produced from the left-side speaker affects the sound which is produced from the right-side speaker for the right ear of the listener, while the sound component produced from the right-side speaker affects the sound which is produced from the left-side speaker for the left ear of the listener. Thus, in order to cancel the above-mentioned cross-talk components, the cross-talk canceler 39 performs the convolution process by use of the phase-inverted signal having the phase which is inverse to that of the cross-talk component. Under operation of this cross-talk canceler 39, the outputs of the sound-directional device 33 are converted into the sounds which are roughly heard by the left ear only from the left-side speaker, while the outputs of the sound-directional device 34 are converted into the sounds which are roughly heard by the right ear only from the right-side speaker. Such sound allocation can roughly embody the situation in which the listener hears the sounds by use of the headphone set.

Meanwhile, the cross-talk canceler 39 receives a cross-talk bypass signal BP from the control portion 31. This cross-talk bypass signal BP is automatically produced by the control portion 31 when inserting the headphone plug into the headphone jack (not shown). When the headphone plug is not inserted, the cross-talk bypass signal BP is turned off, so that the sounds are reproduced from two speakers while canceling the cross-talk components as described before. On the other hand, when the headphone plug is inserted, the cross-talk canceling operation is omitted, so that the signals are supplied to the headphone set from which the sounds are reproduced.

Next, a description will be given with respect to the method of how to control and fix the sound-image position by the panning signal PS. When the value of the panning signal PS is equal to zero, the foregoing sound effect signal EFS is supplied to the sound-directional device 34 only. Thus, the sound-image position is fixed at the position of the virtual speaker (i.e., the position of the speaker 45 in FIG. 13) which is located by the sound-directional device 34. On the other hand, when the value of the panning signal PS is at "1", the sound effect signal EFS is supplied to the sound-directional device 33 only, and consequently, the sound-image position is fixed at the position of the virtual speaker (i.e., the position of a speaker 46) which is located by the sound-directional device 33. When the value of the panning signal PS is set at a point between "0" and "1", the sound-image position is fixed at an interior-division point corresponding to the panning signal PS between the virtual speakers 45, 46.

(b) Operation of Fourth Embodiment

Next, a description will be given with respect to the operation of the fourth embodiment by referring to FIG. 13. In FIG. 13, a player 41 is positioned at the center, whereas the left-side speaker 43 is located at the left/front-side position from the player 41 which is defined by $\phi=45°$, $\theta=0°$, r=1.5 m, while the right-side speaker 44 is located at the right/front-side position from the player 41 which is defined by $\phi=-45°$, $\theta=0°$, r=1.5 m. In front of the player 41, there is located a display screen 42 of the video device 23. In the present embodiment this display screen 42 has a flat-plate-like shape, however, it is possible to form this screen from a curved surface which surrounds the player 41.

For example, the player 41 plays the game and a duel scene of a Western is displayed. In this case, the game device 21 outputs the scene-identification signal SCS to the control portion 31 in the sound-image position control apparatus 22, wherein this scene-identification signal SCS has the predetermined scene-identifying value, e.g., four-bit data "0111". Then, the control portion 31 reads out coefficient data CL, corresponding to the scene-identification signal SCS, from the coefficient memory 32, wherein this coefficient data CL represents the coefficient for the FIR filter which corresponds to the position of the left-side virtual speaker 45 (defined by $\phi=85°$, $\theta=0°$, r=3.5 m). This coefficient data CL is supplied to the sound-directional device 33. In addition, the control portion 31 also reads out another coefficient data CR representing the coefficient for the FIR filter which corresponds to the position of the right/upper side virtual speaker 46 (defined by $\phi=-40°$, $\theta=65°$, r=15.0 m). This coefficient data CR is supplied to the sound-directional device 34. Thus, the virtual speakers 45, 46 are located at their respective positions as shown in FIG. 13.

The game device 21 produces the musical tone signals ML, MR which are sent to the speakers 43, 44 via the adders 25, 26 and amplifier 24, whereas the music suitable for the duel scene is reproduced, while the other background sounds such as the wind sounds are also reproduced, independent of the sound-image position control. In response to a shot action of a gunfighter (which is the displayed image and plays an enemy role for the player 41 in the gunfight game), the sound effect signal EFS representing a gunshot sound is supplied to the sound-image position control apparatus 22. In this case, if the value of the panning signal PS is equal to zero, the gunshot is merely sounded from the position of the virtual speaker 46. Such sound effect corresponds to a scene in which the gunfighter shoots a gun by aiming at the player 41 from the second floor of the saloon. On the other hand, if the value of the panning signal PS is equal to "1", the gunshot may be sounded in the scene in which the gunfighter is placed at the left-side position very close to the player 41 and then the gunfighter shoots a gun at the player 41. If the value of the panning signal PS is set at certain value between "0" and "1", the gunfighter is placed at certain interior-division points on the line connected between the virtual speakers 45, 46, and then the gunshot is sounded.

The game device 21 is designed such that even in the same duel scene of the Western, every time the position of the enemy is changed, a new scene-identification signal SCS (having a new binary value such as "1010") is produced and outputted to the sound-image position control apparatus 22. In other words, the change of the position of the enemy is treated as a change of the scene. Thus, the virtual speakers will be located again in response to the new scene.

Other than the above-mentioned Western game, the game device 21 can also play an automobile race game. Herein, the game device 21 outputs a new scene-identification signal SCS (having a binary value such as "0010"), by which the control portion 31 reads out two coefficient data respectively corresponding to the right/front side virtual speaker and right/back-side virtual speaker. These coefficient data are respectively supplied to the sound-directional devices 33, 34. In this case, the foregoing signals ML, MR represent the background music and the engine sounds of the automobile to be driven by the player 41. Further, the foregoing signal EFS represents the engine sounds of other automobiles which will be running in the race field as the displayed images. On the basis of the foregoing operation routine, the panning signal PS is computed and renewed in response to the position relationship between the player's automobile and the other automobiles. If another automobile is running faster than the player's automobile so that another automobile gets ahead of the player's automobile, the value of the panning signal PS is controlled to be gradually increased from "0" to "1". Thus, in response to the scene in which another automobile gets ahead of the player's automobile, the sound-image position of the engine sound of another automobile is controlled to gradually move ahead.

As described above, the fourth embodiment is applied to the game device. However, it is possible to modify the present embodiment such that the sound-image position control is performed in response to the video scene played by a video disk player. It is also possible to apply the present embodiment to a CD-I system. In this case, the foregoing scene-identification signal SCS and panning signal PS can be recorded on the sub-code track provided for the audio signal.

The present embodiment uses two sound-directional devices. However, it is possible to modify the present embodiment such that three or four sound-directional devices are provided to cope with more complicated video scenes. In this case, the complicated control must be performed on the panning signal PS. However, it is not necessary to provide hundreds of sound-directional devices, nor is it necessary to simultaneously change hundreds of coefficients for the FIR filters.

The sound-directional device of the present embodiment is configured by FIR filters. However, this device can be configured by the infinite-impulse response digital filters (i.e., IIR filters). For example, the so-called notch filter is useful when fixing the sound-image position with respect to the elevation-angle direction. Further, it is also known that a band-pass filter controlling the specific frequency-band is useful when controlling the sound-image position with respect to the front/back direction. When embodying such filter by use of the IIR filters, the fixing degree of the sound-image position may be reduced as compared to the FIR filters. However, the IIR filter has a simple configuration as compared to the FIR filter, so that the number of the coefficients can be reduced. In short, the IIR filter is advantageous in that controlling can be made easily.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A sound-image position control apparatus comprising:

a plurality of real speakers including right-side and left-side speakers, each of which converts a signal input thereto into a sound;

a sound source means for generating plural audio signals;

a virtual-speaker position control means for receiving plural audio signals and then applying different delay times to each of said plural audio signals so as to output delayed signals as right-side and left-side audio signals to be supplied respectively to the right-side and left-side speakers of the plurality of speakers, thus controlling positions of virtual speakers, each of which virtually produces sounds corresponding to said plural audio signals at a position corresponding to the applied different delay times, wherein the positions of the virtual speakers are producable outside, as well as inside, an area between the plurality of real speakers, and wherein said virtual-speaker position control means includes:

a plurality of virtual speaker forming circuits coupled to the real speakers, each of the plurality of virtual speaker forming circuits processing each of said plural audio signals so that a sound generated by at least two of the real speakers is localized at a position of a corresponding virtual speaker; and a distributing circuit which receives each of said plural audio signals from the sound source means and then distributes it among at least two of the virtual speaker forming circuits at a distribution ratio;

a display means for displaying an animated image character on a display screen thereof, said animated image character corresponding to at least one of the sounds to be virtually produced from among said virtual speakers, wherein a display position of said animated image character corresponds to a position of at least one of the sounds virtually produced from among said virtual speakers, wherein the position of the at least one of the sounds corresponding to said animated image character is moved in accordance with a movement of said animated image character on the display screen of said display means, and wherein a sound corresponding to each of said plural audio signals from the sound source means is localized at a position between the positions of at least two virtual speakers in accordance with the distribution ratio; and a conversion memory for storing coefficients corresponding to positions of the animated image character on the display screen, wherein at least one of the plurality of virtual speaker forming circuits processes an audio signal corresponding to the animated image character based on the coefficients so that the position of a sound corresponding to the processed audio signal is moved in accordance with a movement of the animated image character on the display screen.

2. A sound-image position control system comprising:

a means for producing a video signal and an audio signal which are related to each other;

a scene-identification signal producing means for producing a scene-identification signal corresponding to each scene of a display image;

a plurality of real speakers;

a sound-image forming means for driving said real speakers by performing a predetermined signal processing on said audio signal so as to form a sound image and a plurality of virtual speakers at predetermined positions, at least one of the plurality of virtual speakers being locatable outside of an area between said plurality of real speakers, as well as inside an area between said plurality of real speakers, and wherein a sound of the audio signal is distributed between at least two of the plurality of virtual speakers so that the sound is localized between the at least two virtual speakers;

a control means for modifying the signal processing performed on said audio signal, the modified signal processing being selected in response to a change in said scene-identification signal so as to control a sound-image position of said audio signal and the plurality of virtual speakers based upon the changed scene-identification signal; and a conversion memory for storing coefficients corresponding to a plurality of scenes of the display image, wherein the control means processes the audio signal based on the coefficients so that the position of a sound corresponding to the processed audio signal is moved in accordance with a change of scenes of the display image.

3. A sound-image position control system comprising:

an audio/video information producing means for producing a video signal and an audio signal which are related to each other, said means also producing a scene-identification signal corresponding to each scene of a display image which is displayed by a display unit;

at least two real speakers which are respectively located at predetermined positions;

a sound-image forming means for performing a predetermined signal processing on said audio signal so that said apparatus forms a sound image and a plurality of virtual speakers at respective positions in a three-dimensional space surrounding a person positioned so as to watch the display image, wherein at least one of the virtual speaker positions is producable outside of an area between the at least two real speakers, and wherein a sound of the audio signal is distributed between at least two of the plurality of virtual speakers so that the sound is localized between the at least two virtual speakers;

a control means for modifying the signal processing performed on said audio signal, the modified signal processing being selected in response to a change in said scene-identification signal so as to control a sound-image position of said audio signal and the plurality of virtual speakers based upon the changed scene-identification signal; and a conversion memory for storing coefficients corresponding to a plurality of scenes on the display unit, wherein the control means processes the audio signal based on the coefficients so that the position of a sound corresponding to the processed audio signal is moved in accordance with a change of scenes of the display unit.

4. A sound-image position control system as defined in claim 3, wherein said sound-image forming means includes at least two virtual-speaker position control means which respectively perform predetermined signal processings corresponding to said scene-identification signal on said audio signal so as to form at least two virtual speakers by which the sound image corresponding to said audio signal is formed and which are changed in accordance with the scene-identification signal.

5. A sound-image position control system as defined in claim 4, wherein said audio/video information producing means also produces a panning signal by which the sound-image position is located at certain interior-division point in linear space connected between said virtual speakers.

6. A sound image position control system as defined in claim 3, wherein said sound-image forming means is configured by use of a finite-impulse response digital filter (i.e., FIR filter).

7. A sound-image position control apparatus comprising:

a plurality of real-speakers, each of which converts a signal input thereto into a sound;

at least two virtual-speaker means each of which receives an input signal and then performs a predetermined signal processing on the input signal so as to output processed signals as right-side and left-side audio signals to be supplied to the real-speakers, wherein a sound of the received input signal is produced by the plurality of real-speakers at a position outside, as well as in an area between, the plurality of real-speakers so that the sound is perceived as the sound is produced by a virtual-speaker at the position;

an allocation means which receives an audio signal and then allocates the audio signal between the at least two virtual-speaker means at a distribution (or "panning") ratio; and addition means which respectively adds the right-side audio signals and the left-side audio signals output by the at least two virtual-speaker means and provides the real speakers with the added right-side audio signals and the added left-side audio signals, wherein each of the sounds corresponding to the audio signals is located at a position between at least two virtual-speakers formed by the at least two virtual-speaker means in accordance with the distribution ratio;

providing means for providing the at least two virtual-speaker means with a control signal and a distribution signal; and a coefficient memory for storing coefficients corresponding to values of the control signal, wherein the positions of the virtual speakers are controlled in accordance with the coefficients corresponding to the provided control signal, and the distribution ratio is determined based on the provided distribution signal.

8. A sound-image position control apparatus as defined in claim 7, further providing a cross-talk canceling means between said addition means and said plurality of real-speaker means, said cross-talk canceling means for canceling cross-talk between provided to said plurality of real-speaker means.

9. A sound-image position control apparatus comprising:

at least two real speakers each of which converts a signal input thereto into a sound;

at least two virtual-speaker means each of which receives an input signal and then applies different delay times to the input signal so as to output delayed signals as right-side and left-side audio signals to be supplied to the at least two real speakers, wherein a sound corresponding to the input signal is localized at a position of a virtual speaker which virtually produces the sound at a desirable position in response to the different delay time, wherein the positions of the at least two virtual speakers are producable outside of an area between the at least two real speakers;

an allocation means which receives an audio signal and allocates the audio signal between the at least two virtual-speaker means at a panning ratio;

control means for providing the allocation means with first data representing a panning ratio in response to a desirable localizing position, wherein a sound corresponding to the audio signal is controlled to be localized at a position in a space between the virtual speakers in accordance with the first data;

providing means for providing the at least two virtual-speaker means with a control signal and a distribution signal; and a coefficient memory for storing coefficients corresponding to values of the control signal, wherein the positions of the at least two virtual speakers are controlled in accordance with the coefficients corresponding to the provided control signal and the distribution ratio is determined based on the provided distribution signal.

10. A sound-image position control apparatus according to claim 9, wherein the control means also provides each of the at least two virtual-speaker means with second data representing different delay times, wherein a sound corresponding to the input signal is controlled to be localized at a position of the virtual speaker which is formed at a position corresponding to the second data.

11. A sound-image position control apparatus according to claim 10, further comprising:

display means which displays a predetermined animated image on a display screen thereof, wherein a position of the sound corresponding to the audio signal corresponds to a position of the animated image in the display screen.

12. A sound-image position control apparatus according to claim 11, wherein the control means change the second data based on a scene-identification signal representing a kind of a scene on the display screen.

13. A sound-image position control apparatus comprising:

only two real speakers including a right-side and a left-side speaker, each of which converts a signal input thereto into a sound;

a sound source circuit that generates a plurality of audio signals;

a virtual-speaker position control circuit that receives the plurality of audio signals and then applies different delay times to each of the plurality of audio signals to output delayed signals as right-side and left-side audio signals which are supplied to the right-side and the left-side speakers of the two real speakers to control sound-image positions of a plurality of virtual speakers, each of the plurality of virtual speakers is positioned independently of each of the other of the plurality of virtual speakers and each virtually produces sounds corresponding to the plurality of audio signals, wherein the sound image position of at least one of the virtual speakers is producable outside of an area between the two real speakers, and wherein a sound of the audio signal is distributed between at least two of the plurality of virtual speakers so that the sound is localized between the at least two virtual speakers;

providing means for providing the virtual-speaker position control circuit with a control signal and a distribution signal; and a coefficient memory for storing coefficients corresponding to values of the control signal, wherein the positions of the plulaity of virtual speakers are controlled in accordance with the coefficients corresponding to the provided control signal, and the distribution ratio is determined based on the provided distribution signal.

14. A sound-image position control apparatus according to claim 13, wherein the virtual-speaker position control circuit includes:

a plurality of virtual speaker forming circuits coupled to the two real speakers, each of the plurality of virtual speaker forming circuits processing each of the plurality of audio signals so that a sound generated by the two real speakers is localized at a position of a corresponding virtual speaker; and a distributing circuit that receives each of the plurality of audio signals and then distributes it among at least two of the plurality of virtual speaker forming circuits at a distribution ratio, wherein a sound corresponding to each of the plurality of audio signals is localized at a position in a space including the positions of at least two of the plurality of virtual speakers in accordance with the distribution ratio.

15. A sound-image position control apparatus according to claim 13, further comprising:

a display having a display screen that displays a predetermined animated image, the animated image corresponding to the sounds that are virtually produced from each of the plurality of virtual speakers, wherein a display position of the animated image corresponds to a position of the a sound-producing point generated by the plurality of virtual speakers, and wherein the position of the sound-producing point corresponding to the animated image is moved in accordance with a movement of the animated image on the display screen of said display.

16. A sound-image position control apparatus according to claim 13, further comprising:

a scene-identification signal producing circuit that produces a scene-identification signal corresponding to each scene of a display image; and a control circuit that modifies the plurality of audio signals from the sound source circuit, the modified signal processing being selected in response to a change in the scene-identification signal such that sound-image positions of the plurality of audio signals are controlled based upon the changed scene-identification signal.

17. A sound-image position control apparatus according to claim 13, wherein the right-side speaker and the left-side speaker are placed at any position in a 3 dimensional volume surrounding the sound image control apparatus.

18. A sound-image position control apparatus according to claim 13, wherein the plurality of virtual speakers and the sound corresponding to each of the plurality of corresponding audio signals is localized in at least two dimensions.

19. A sound-image position control apparatus according to claim 13, wherein the plurality of virtual speakers and the sound corresponding to each of the plurality of corresponding audio signals is localized in three dimensions.

* * * * *